US006244351B1

(12) United States Patent
Patel et al.

(10) Patent No.: US 6,244,351 B1
(45) Date of Patent: Jun. 12, 2001

(54) PRESSURE-CONTROLLED ACTUATING MECHANISM

(75) Inventors: Dinesh R. Patel, Sugar Land; Anthony P. Vovers, Houston, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/480,083

(22) Filed: Jan. 10, 2000

Related U.S. Application Data

(60) Provisional application No. 60/115,417, filed on Jan. 11, 1999.

(51) Int. Cl.[7] ..... E21B 34/10

(52) U.S. Cl. ..... 166/386; 166/319; 166/332.1

(58) Field of Search ..... 166/386, 316, 166/319, 321, 332.1, 334.4

(56) References Cited

U.S. PATENT DOCUMENTS

| | | | | |
|---|---|---|---|---|
| 2,798,561 | | 7/1957 | True . | |
| 2,951,536 | | 9/1960 | Garrett . | |
| 2,963,089 | | 12/1960 | Sizer . | |
| 3,412,806 | | 11/1968 | Fredd et al. . | |
| 3,640,341 | | 2/1972 | Braddick et al. . | |
| 3,912,008 | | 10/1975 | Crowe . | |
| 4,043,392 | | 8/1977 | Gazda . | |
| 4,143,712 | | 3/1979 | James et al. . | |
| 4,215,746 | | 8/1980 | Hallden et al. . | |
| 4,280,561 | | 7/1981 | Fredd . | |
| 4,354,554 | | 10/1982 | Calhoun et al. . | |
| 4,356,867 | | 11/1982 | Carmody . | |
| 4,417,600 | | 11/1983 | Kohn . | |
| 4,420,045 | | 12/1983 | McMahan . | |
| 4,589,482 | | 5/1986 | Bayh, III . | |
| 4,624,310 | | 11/1986 | Echols et al. . | |
| 4,627,492 | | 12/1986 | MacLaughlin . | |
| 4,771,831 | | 9/1988 | Pringle et al. . | |
| 4,934,460 | * | 6/1990 | Coronado | 166/386 |
| 4,979,569 | | 12/1990 | Anyan et al. . | |
| 5,058,673 | | 10/1991 | Muller et al. . | |
| 5,090,481 | | 2/1992 | Pleasants et al. . | |
| 5,180,015 | * | 1/1993 | Ringgenberg et al. | 166/386 |
| 5,257,663 | | 11/1993 | Pringle et al. . | |
| 5,263,683 | | 11/1993 | Wong . | |
| 5,337,827 | | 8/1994 | Hromas et al. . | |
| 5,518,073 | | 5/1996 | Manke et al. . | |
| 5,609,178 | * | 3/1997 | Hennig et al. | 166/317 X |
| 5,664,629 | | 9/1997 | Maitland . | |
| 5,810,087 | | 9/1998 | Patel . | |
| 5,941,308 | | 8/1999 | Malone et al. . | |
| 6,173,786 | * | 1/2001 | Sampson et al. | 166/383 |

FOREIGN PATENT DOCUMENTS

| | | | |
|---|---|---|---|
| 0275612 | 7/1988 | (EP) | 33/127 |
| 0 859 123 A2 | 8/1998 | (EP) . | |
| 2 213 181 | 8/1989 | (GB) . | |
| 2279385 | 1/1995 | (GB) | 23/6 |
| WO 92/08875 | 5/1992 | (WO) . | |

OTHER PUBLICATIONS

Schlumberger, *Formation Isolation Valve* (*FIV*), p. 1 (Jan. 1997).

Schlumberger, *Liner Top Isolation Valve—LTIV,* p. 1 (Publication Date Unknown).

(List continued on next page.)

*Primary Examiner*—Frank Tsay
(74) *Attorney, Agent, or Firm*—Trop Pruner & Hu P.C.

(57) ABSTRACT

A well string for use in a wellbore having plural fluid regions includes a flow conduit having an inner bore defining one of the fluid regions and an actuating assembly including an operator mechanism, an activation port in communication with the operator mechanism, and a member adapted to block the activation port. The member is moveable by an applied pressure in a first fluid region to expose the activation port to a second fluid region. The operator mechanism includes a piston assembly. The first fluid region may include the annulus region outside the flow conduit, and the second fluid region may include the flow conduit inner bore.

20 Claims, 3 Drawing Sheets

OTHER PUBLICATIONS

Schlumberger, *Formation Isolation Valve* (*FIV*), p. 1 (Aug. 1997).
Schlumberger, *Liner Top Isolation Valve*—(*LTIV**), p. 1 (Sep. 1997).
Schlumberger, *IRIS* Operated Dual Valve* (*IRDV–AB*), p. 1 (Oct. 1997).
Schlumberger, *Single–Shot Reversing Valve* (*SHRV*), p. 1 (Dec. 1996).
US Patent Application Serial No. 08/762,762, entitled Surface Controlled Formation Isolation Valve Adapted for Deployment of a Desired Length of a Tool String in Wellbore, filed Dec. 10, 1996.
US Patent Application Serial No. 09/108,674, entitled Formation Isolation Valve, filed Jul. 1, 1998.
US Patent Application Serial No. 09/034,206, entitled Inflatable Shifting Tool, filed Mar. 3, 1998.

* cited by examiner

PRESSURE-CONTROLLED ACTUATING MECHANISM

This application claims priority under 35 U.S.C. §119(e) to U.S. Provisional Ser. No. 60/115,417, entitled "PRESSURE CONTROLLED ACTUATING MECHANISM," filed Jan. 11, 1999.

BACKGROUND

The invention relates to pressure-controlled actuating mechanisms for use with tools in wellbores.

Downhole tools for performing various tasks in a wellbore may include valves, packers, perforators, and other devices. A wellbore typically is lined with casing, with a production tubing string extending in the wellbore to produce hydrocarbons to the well surface. Packers may be used to provide a seal between the outer surface of a downhole tool and the inner wall of a casing, liner, or open hole. Perforators, such as perforating guns, are used to create perforations in surrounding formation to enable fluid flow. Valves are used to control fluid flow. To actuate such downhole tools as well as other types of tools, various actuating mechanisms may be utilized, including mechanical, electrical, or pressure-activated mechanisms. Pressure-controlled mechanisms may be activated by pressure transmitted through a tubing, an annulus region between the tubing and the casing, or a separate control line.

A conventional type of pressure-controlled actuating mechanism, such as one used for setting a packer or another type of downhole tool, is activated by differential pressure between the inner bore of the tubing and the annulus between the tubing and the casing. The differential pressure may be raised by increasing the pressure in the annulus region or in the tubing bore. With such actuating mechanisms, however, inadvertent rises or drops in tubing bore pressure or annulus pressure may cause accidental setting of a packer or actuation of another tool, which may cause disruptions in well operation. For example, if a packer is set at the wrong depth, the packer will have to be un-set, which may require the lowering of an intervention tool into the wellbore. If a perforating gun is fired in the wrong place, destruction of downhole equipment may occur.

The inadvertent actuation of a downhole tool may cause a well to be inoperable for some amount of time, which may be costly. In addition, inadvertent actuation of certain types of downhole tools, such as perforators, raises safety concerns. A need thus exists for a pressure-controlled actuating mechanism that is protected from inadvertent activation due to pressure fluctuations.

SUMMARY

In general, according to one embodiment, a well string for use in a wellbore having plural fluid regions includes a flow conduit having an inner bore defining one of the fluid regions and an actuating assembly including an operator mechanism, an activation port in communication with the operator mechanism, and a member adapted to block the activation port. The member is moveable by an applied pressure in a first fluid region to expose the activation port to a second fluid region.

Other features and embodiments will become apparent from the following description and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
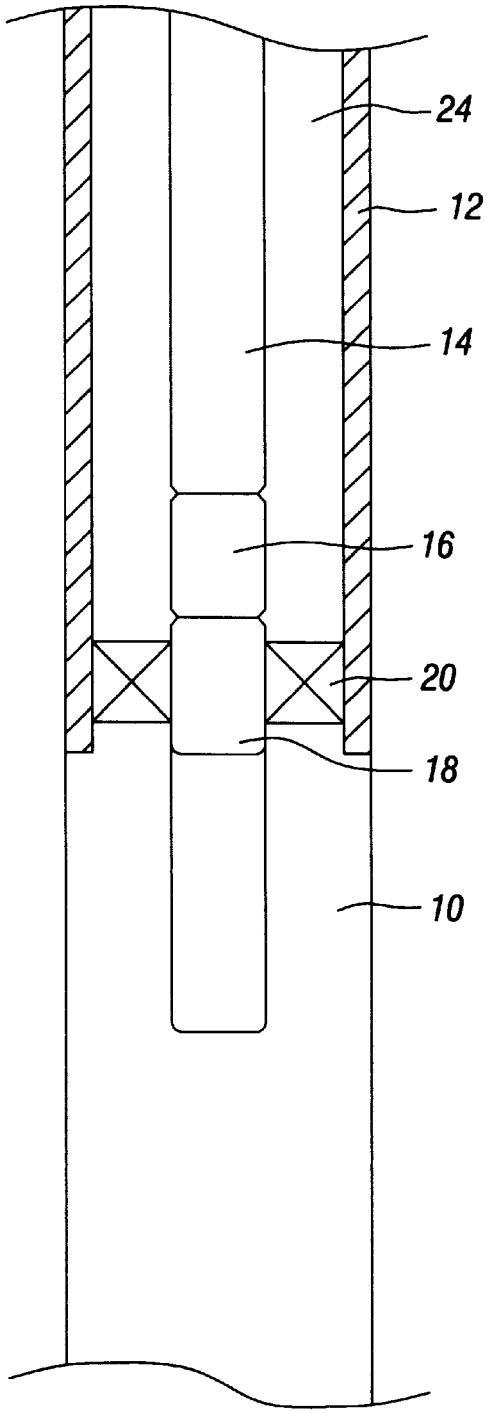
FIG. 1 is a diagram of an embodiment of a completion string in a wellbore.

Referring to FIG. 1, according to one embodiment, a tubing 14 (which may be a production tubing, for example) is positioned in a wellbore 10 that is lined with casing 12. The tubing 14 may be connected to a packer tool 18 and an associated pressure-controlled actuating mechanism 16 according to one embodiment. Although the illustrated embodiment depicts the packer tool 18 as being separate from the actuating mechanism 16, the packer and actuating mechanism may be integrated in a single unit in further embodiments. The packer tool 18 includes a packing or sealing element 20 formed of a resilient material that is expandable radially outward to the casing wall by compressive force applied by the actuating mechanism 16. The packing element 20 is set against the wall of the casing 12 to provide a seal to isolate a lower annulus portion of the wellbore 10 from a casing-tubing annulus region 24 above the packer tool 18. Other types of tools may be used with the actuating mechanism 16 or a variation or modification of such mechanism in further embodiments.

In accordance with some embodiments, a protection device is implemented in the actuating mechanism 16 to prevent or reduce the likelihood of inadvertent activation of the pressure-controlled actuating mechanism 16. The protection device includes at least a sleeve moveable by annulus pressure to expose one or more activation ports so that tubing pressure may be communicated to an operator piston assembly. In further embodiments, other flow conduits, which may include pipes, control lines, and other fluid paths, may be employed to communicate fluid pressure to activate the protection device. Thus, more generally, the wellbore may be separated into several fluid regions, with the flow conduit providing a first fluid region and a region outside the flow conduit (e.g., an annulus region) providing a second fluid region. The protection device may be activated to expose one or more activation ports by application of fluid pressure in one of the fluid regions, with fluid pressure applied in another one of the fluid regions communicated through the one or more activation ports to activate the actuating mechanism.

In the illustrated embodiment, the protection device is activated by pressure in the annulus region outside the tubing 14. Pressure communicated in the tubing 14 may then be used to activate the actuating mechanism. However, the invention is not to be limited in this respect, as further embodiments may generally have fluid pressure in a first region moving the protection device to an activated position and fluid pressure in a second region activating the actuating mechanism.

To activate the actuating mechanism 16 according to one embodiment, the following operations are performed. After the packer 18 is lowered to a desired position, pressure in the annulus region 24 between the casing 12 and tubing 14 is increased to move the sliding sleeve in the actuating mechanism 16 from an inactive to an active position. This exposes one or more activation ports to the inner bore of the tubing 14 so that tubing pressure can be communicated to the operator piston assembly, which in one embodiment includes two operator pistons arranged in series (referred to as upper and lower operator pistons below). When the sliding sleeve is in an inactive position, the activation port is sealed from the inner bore of the tubing 14 so that tubing pressure is not communicated to the operator piston assembly. If the sliding sleeve is in its active position, however, and sufficient tubing pressure is applied, then the operator piston assembly is actuated. In an alternative embodiment, operator piston assembly may be actuated by the annulus pressure, with tubing pressure used to move the sliding sleeve to uncover the one or more activation ports that allow communication between the annulus pressure and the operator piston assembly.

Figure 2:
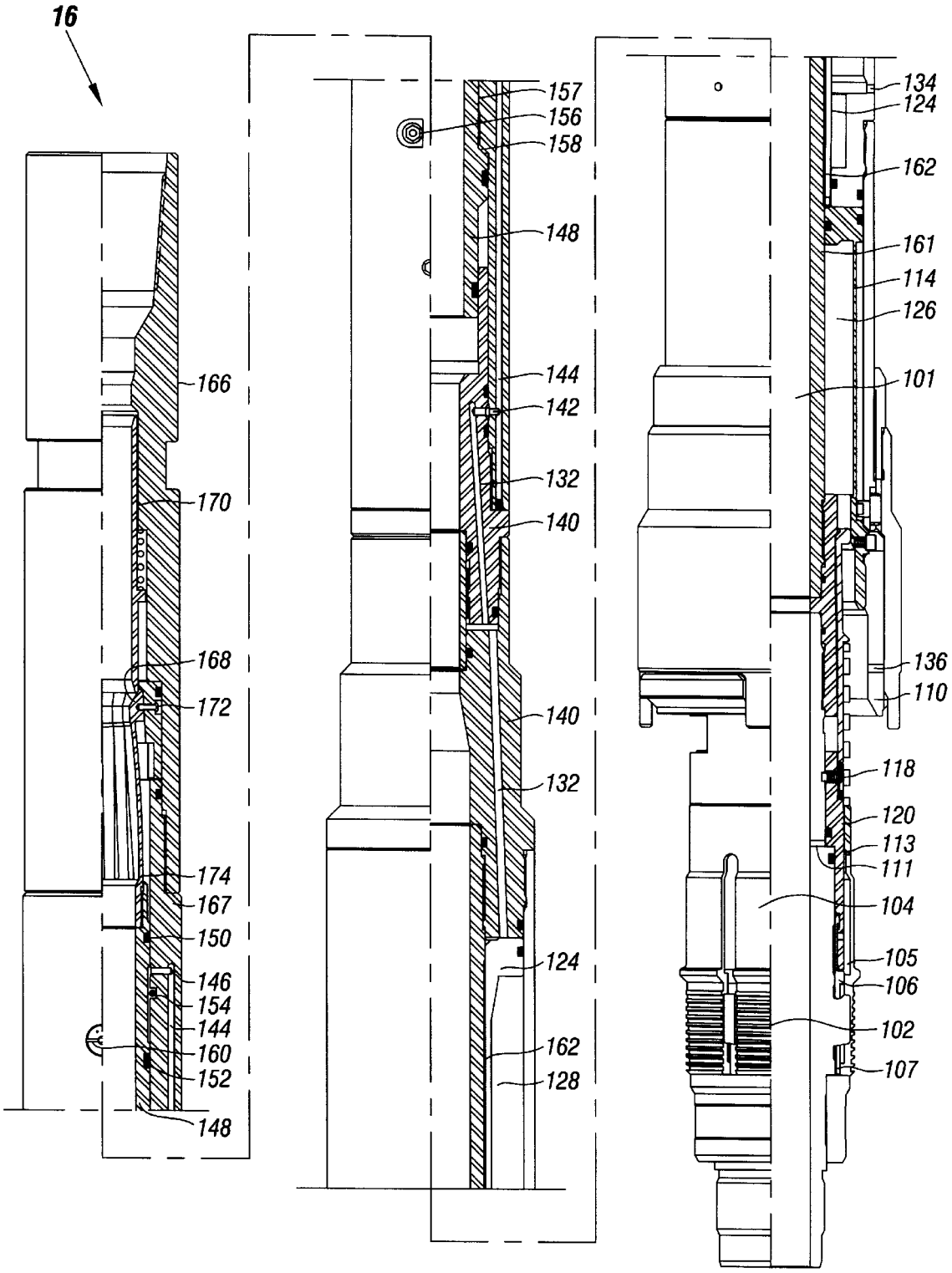
FIG. 2 is a longitudinal sectional view of a pressure-controlled actuating mechanism according to one embodiment that is part of the completion string of FIG. 1.

Referring to FIG. 2, according to one embodiment, the actuating mechanism 16 at its lower end includes a collet 104 having a threaded portion 102 for coupling to the packer 18. A setting member 110 is actuatable downwardly by the operator piston assembly (including a lower operator piston 114 and upper operator piston 124) in response to an applied tubing pressure in an inner bore 101 defined by the housing of the actuating mechanism 16. The setting member 110 moves downwardly a predetermined distance to apply a force against elements in the packer 18 to actuate such elements (e.g, resilient sealing elements and anchor slips).

The upper side of the lower operator piston 114 is in contact with the lower end of the upper operator piston 124 and is in communication with fluid pressure in a narrow channel 162 defined between the upper operator piston 124 and an inner mandrel 161. The lower side of the lower operator piston 124 is in communication with a chamber 126. A port 136 allows fluid in the annulus region outside the housing of the actuating mechanism 16 to flow into the chamber 126.

The upper operator piston 124 has an upper side that is in communication with fluid pressure in a lower channel 132. The lower side of the upper operator piston 124 is in communication with a chamber 128, which is at the annulus pressure as communicated through a port 134. As used here, "annulus pressure" generally refers to fluid pressure that is applied from outside the housing of the actuating mechanism 16, such as the annulus region 24. "Housing" may refer to a singular housing section or to multiple housing sections connected together.

The use of the two operator pistons 114 and 124 increases the effective area exposed to fluid pressure in the tubing 14 so that a greater activation force may be applied against the operator piston assembly.

The channel 132 extends up through a pressure transfer sub 140 to a port 142. The port 142 connects the lower channel 132 to an upper channel 144 located in a housing section 147 of the actuating mechanism 16. The upper channel 144 extends up to an activation port 146 that opens into the inner bore 101 of the actuating mechanism 16. However, fluid communication between the inner bore 101 and the activation port 146 is blocked (as illustrated) by a moveable blocking member 148 (e.g., a sliding sleeve) while the blocking member 148 is in its inactive position. As a result, any increase in tubing pressure (such as due to pressure fluctuations or pulses) does not activate the actuating mechanism 16 until the sliding sleeve 148 is moved downwards to its active position (described below). The port 146 is sealed from the inner bore 101 by two sealing elements 150 and 152 (e.g., O-ring seals) carried by the sliding sleeve 148.

A back-up sealing element 154, which may also be an O-ring seal, may be located in a groove defined in the wall of a housing section 167. The seal 154 may be located between the two seals 150 and 152. The outer surface of the sleeve 148 includes a recess 155 so that the sleeve outer surface does not contact the seal 154 when the sleeve 148 is in its up or inactive position. However, as the sleeve 148 moves downwardly, the recess 155 in the sleeve 148 moves past the seal 154 so that the outer surface of the sleeve 148 engages the seal 154. This provides a sealing engagement between the sleeve outer surface and the seal 154.

The seal 154 protects the seal 150 as the sliding sleeve 148 moves downwardly by preventing annulus pressure communicated through a port or valve 160 from jamming the seal 150 against the activation port 146. Thus, when the seal 150 passes the port 146, its integrity is maintained. Once the seal 150 has moved below the activation port 146, the seals 150, 152, and 154 prevent fluid in the annulus region 24 from flowing through the port or valve 160 to the activation port 146. Thus, effectively, the port or valve 160 and the activation port 146 are isolated from each other once the sliding sleeve 148 has moved downwardly to its active position.

Figure 3:
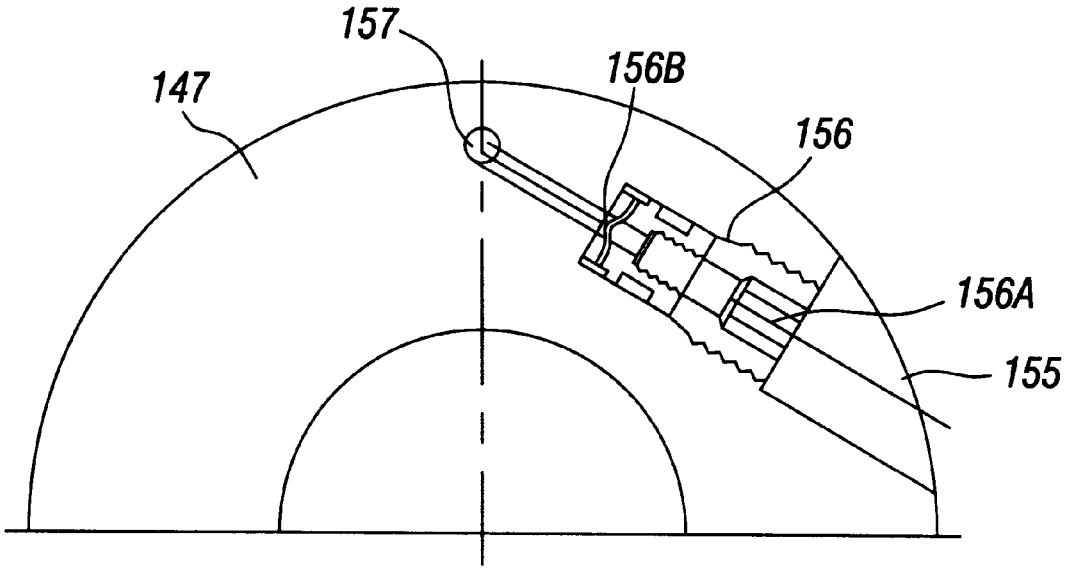
FIG. 3 is a diagram of a rupture disk assembly in the actuating mechanism of FIG. 2.

In its inactive position, the sliding sleeve 148 blocks communication of fluid pressure in the bore 101 of the actuating mechanism 16 from reaching the operator pistons 124 and 114 through channels 144 and 132. The channels 144 and 132 are instead filled with wellbore fluids communicated through a port 160. As a result, both sides of the operator piston assembly are at the annulus fluid pressure, which prevents activation of the lower and upper pistons 114 and 124. To move the sliding sleeve 148 to its active position to expose the activation port 146 to tubing pressure in the inner bore 101, fluid pressure in the casing-tubing annulus region 24 is increased to a predetermined level. The applied predetermined pressure in the casing-tubing annulus 24 ruptures a rupture disk assembly 156 located in the housing section 147. Referring further to FIG. 3, a port 155 exposes the rupture disk assembly 156 to fluid pressure in the casing-tubing annulus region 24. A rupture disk 156B held in a rupture disk retainer 156A blocks annulus fluid from a channel 157, which extends to an upper shoulder 158 of the sliding sleeve 148 (FIG. 2).

When the sleeve 148 is in its active position, the port or valve 160 is isolated from the activation port 146, which allows tubing pressure to enter through the activation port 146 to the channels 144 and 132 to act on the operator piston assembly.

The actuating mechanism 16 also includes a back-up mechanical operator that may be used if the sliding sleeve 148 cannot be moved from its inactive position by annulus pressure. The back-up mechanical operator is located in a top sub 166, which includes a seat 168 formed in an upper portion of a ball seat sleeve 174 that is adapted to receive a ball (not shown) lowered from the surface. Once the ball is received in the seat 168, the section of the actuating mechanism 16 below the ball is sealed from the upper section of the actuating mechanism 16. A shear pin 172 is attached to the ball seat sleeve 174 to restrain the ball seat sleeve 174. The lower portion of the ball seat sleeve 174 is attached to the upper portion of the sliding sleeve 148. Thus, downward movement of the ball seat sleeve 174 moves the sliding sleeve 148 downwardly to expose the activation port 146 so that tubing pressure may be communicated to the channels 144 and 132.

The actuating mechanism 16 also includes a release assembly to release the actuating mechanism 16 from the packer tool 18. At the lower end of the actuating mechanism, the tubing pressure is also communicated through a port 111 to a shoulder 113 of a release piston 120. The release piston 120 is held in place by a shear pin 118. Application of the tubing pressure to a threshold level (which may be above the pressure needed to set the packer 18) breaks the shear pin 118 to allow upward movement of the release piston 120. Movement of the release piston 120 moves a support sleeve 107, which in the illustrated down position supports the inside of the collet 104 to maintain the threaded coupling between the collet 104 and the packer 18. The support sleeve 107 includes a flange 106 that supports the collet 104.

The flange 106 if moved upwardly can drop into a recess 105 of the collet 104. When this happens, the collet 104 is no longer supported inside and the coupling between the collet 104 and the packer 18 is released to release the actuating mechanism 16 from the packer 18. This allows retrieval of the tubing 14 and actuating mechanism 16 if desired.

In operation, the string including the tubing 14, the packer tool 18, and the actuating mechanism 16 is lowered downhole. As the actuating mechanism 16 is lowered into the wellbore, the chambers 126, 128 and channels 132, 162 in the actuating mechanism 16 are filled with annulus fluids through the various ports (136, 134, and 160). Consequently, the operator pistons 114 and 124 are maintained in their inactive positions as pressures on both sides of the pistons 114 and 124 are substantially equal. Annulus fluids can flow into the chamber 126 through the port 136, into the chamber 128 through the port 134, and into the channels 132 and 162 through the port or valve 160. The protection device (including the sleeve 148) in the actuating mechanism 16 reduces the likelihood of inadvertent setting of the packer tool 18 due to sudden rises in the tubing or annulus pressure. When the packer tool 18 is lowered to a desired depth, the annulus pressure is increased to actuate the protection device from the inactive to an active position.

When a sufficient annulus pressure is applied, the rupture disk 156B (FIG. 3) is ruptured to allow annulus fluid to flow through the port 155 and channel 157 to apply a force against the shoulder 158 of the sliding sleeve 148 (FIG. 2). This causes the sliding sleeve 148 to move downwardly to expose the activation port 146 to tubing pressure in the inner bore 101 of the actuating mechanism 16.

Once the sliding sleeve 148 has moved to its active position, tubing bore fluids can flow through the activation port 146 into the channels 144 and 132 to the upper side of the upper operator piston 124. In addition, tubing fluids can also flow down the channel 162 to the upper side of the lower operator piston 114. If a predetermined elevated tubing pressure is applied against top portions of the operator pistons 124 and 114 such that the force applied by the tubing pressure is greater than the force applied on the lower sides of the pistons by fluid pressure in chambers 128 and 126, the operator pistons 124 and 114 may be actuated downwardly to move the packer setting member 110. The setting member 110 applies a force against elements in the packer tool 18. When the tubing pressure is elevated to a sufficient level, the packer tool elements are set by force applied by the setting member 110.

Thus, activation of the actuating mechanism 16 is controlled by a series of operations: a predetermined annulus pressure is applied to move the sliding sleeve 148 to an active position to expose the activation port 146 to tubing pressure; and the tubing pressure is elevated to operate the operator pistons 124 and 114. As a result, until such operations are performed, unexpected pressure changes in the annulus region 24 or tubing inner bore 101 do not cause inadvertent activation of the actuating mechanism 16. Such pressure changes may be caused by pressure waves from detonation of perforating guns or from other operations, as examples.

Although reference has been made to a packer and a packer actuating mechanism in describing one embodiment of the invention, it is to be understood that the invention is not to be limited in this respect. The same actuating mechanism or some variation or modification thereof may be used with other downhole tools in further embodiments.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. An actuating apparatus for use with a downhole tool in a wellbore including a flow conduit having an inner bore, comprising:

an operator piston;

a port in communication with the operator piston;

a moveable member that when in a first position blocks the port from fluid pressure in the flow conduit inner bore; and an actuating assembly responsive to pressure outside the flow conduit to move the member to a second position to expose the port to the flow conduit inner bore to enable communication of fluid pressure from the flow conduit inner bore to the operator piston.

2. The apparatus of claim 1, wherein the actuating assembly includes a rupture mechanism.

3. The apparatus of claim 1, wherein the moveable member includes a sleeve.

4. The apparatus of claim 3, further comprising first sealing elements coupled to the sleeve to seal the port.

5. The apparatus of claim 4, further comprising an additional sealing element to prevent damage to one or more of the first sealing elements as the sleeve moves.

6. The apparatus of claim 5, wherein the additional sealing element is positioned between the first sealing elements.

7. The apparatus of claim 6, wherein the actuating assembly includes a second port to receive the pressure outside the flow conduit, the first port in communication with the second port when the sleeve is in an inactive position so that pressure on both sides of the operator piston are substantially equal.

8. The apparatus of claim 7, further comprising a wall in which the first port is defined, the sleeve having a recess and the wall having a groove to receive the additional sealing element, a surface of the sleeve engaging the additional sealing element as it moves downwardly to seal the first port from the second port.

9. The apparatus of claim 1, further comprising a second assembly actuatable by pressure in the tubing inner bore to move the member to the second position.

10. The apparatus of claim 1, further comprising at least another operator piston in communication with the port.

11. A method of operating a downhole tool in a wellbore including a flow conduit having an inner bore, comprising:

applying a first pressure outside the flow conduit;

moving a blocking member in response to the first pressure from a first position to a second position to expose an activation port to pressure in the flow conduit inner bore; and applying a pressure in the flow conduit inner bore communicated through the activation port to an operator piston assembly.

12. The method of claim 11, further comprising providing a rupture mechanism to prevent communication of pressure outside the flow area from the blocking member until the first pressure has been reached.

13. A method of operating a downhole tool in a wellbore including a flow conduit having an inner bore, comprising:

applying a first pressure in one of the flow conduit inner bore and region outside the flow conduit;

moving a blocking member in response to the first pressure to expose an activation port;

applying a second pressure in the other one of the flow conduit inner bore and region outside the inner bore; and communicating the second pressure through the activation port to actuate the downhole tool.

14. The method of claim 13, wherein the region outside the flow conduit includes an annulus region.

15. A well string for use in a wellbore having plural fluid regions, comprising:

a flow conduit having an inner bore defining one of the fluid regions;

an actuating assembly including an operator mechanism, an activation port in communication with the operator mechanism, and a member adapted to block the activation port, the member moveable by an applied pressure in a first fluid region to expose the activation port to a second fluid region.

16. The string of claim 15, wherein a region outside the flow conduit includes an annulus region.

17. The string of claim 15, wherein the actuating assembly further includes an operator piston assembly in communication with the activation port.

18. The string of claim 15, further comprising a second port in communication with the activation port when the member is in an inactive position, the second port in communication with the first fluid region when the member is in its inactive position.

19. The string of claim 18, wherein the second port is isolated from the activation port when the member is in its active position.

20. An actuating apparatus for use with a downhole tool in a wellbore, comprising:

a housing having an inner bore;

an operator assembly;

an activation port adapted to communicate fluid pressure in the inner bore to the operator assembly; and a blocking assembly adapted to move between an active position and an inactive position in response to an applied pressure in the inner bore, the blocking assembly blocking fluid pressure communication between the inner bore and the operator assembly in the inactive position and enabling fluid pressure communication in the active position.

* * * * *